US008899631B2

(12) United States Patent
Ng

(10) Patent No.: US 8,899,631 B2
(45) **Date of Patent: *Dec. 2, 2014**

(54) BRUNNIAN LINK MAKING DEVICE AND KIT

(71) Applicant: Choon's Design Inc., Wixom, MI (US)

(72) Inventor: Cheong Choon Ng, Novi, MI (US)

(73) Assignee: Choon's Design Inc., Wixom, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/626,057

(22) Filed: Sep. 25, 2012

(65) Prior Publication Data

US 2013/0020802 A1 Jan. 24, 2013

Related U.S. Application Data

(63) Continuation-in-part of application No. 13/227,638, filed on Sep. 8, 2011, now Pat. No. 8,485,565.

(60) Provisional application No. 61/410,399, filed on Nov. 5, 2010.

(51) Int. Cl.

| | |
|---|---|
| ***B65H 69/04*** | (2006.01) |
| ***A44C 5/00*** | (2006.01) |
| ***A44C 27/00*** | (2006.01) |

(52) U.S. Cl.

CPC ..... *A44C 5/0069* (2013.01); *A44C 27/00* (2013.01)

USPC ..... 289/17

(58) Field of Classification Search

USPC ..... 289/2, 16.5, 17, 18.1; D21/334; 273/281, 288, 309; 66/4

See application file for complete search history.

(56) References Cited

U.S. PATENT DOCUMENTS

| | | | | | |
|---|---|---|---|---|---|
| 222,937 | A | * | 12/1879 | Newcomb | 66/4 |
| 246,648 | A | * | 9/1881 | Wilcox | 66/4 |
| 254,258 | A | | 2/1882 | Barbour | |
| 254,288 | A | | 2/1882 | Dimmick | |
| 289,578 | A | * | 12/1883 | Stewart | 66/4 |

(Continued)

FOREIGN PATENT DOCUMENTS

| | | |
|---|---|---|
| GB | 2147918 | 5/1985 |
| JP | 2003-520083 | 7/2003 |
| JP | 2004-520910 | 7/2004 |
| KR | 10-2001-0012609 | 2/2001 |
| KR | 10-2006-0042108 | 5/2006 |

OTHER PUBLICATIONS

International Search Report & Written Opinion for PCT Application No. PCT/US2011/041553 mailed on Feb. 23, 2012.

(Continued)

*Primary Examiner* — Shaun R Hurley

(74) *Attorney, Agent, or Firm* — Carlson, Gaskey & Olds, P.C.

(57) ABSTRACT

A Brunnian link is a link formed from a closed loop doubled over itself to capture another closed loop to form a chain. Elastic bands can be utilized to form such links in a desired manner. A disclosed kit includes a template for mounting an initial band and a hook utilized for attaching additional bands to the initial bands placed on the template. The template includes pins that hold the initial band in place while additional bands are linked onto each other. The kit further includes a clip utilized to attach ends once the desired length is formed.

24 Claims, 6 Drawing Sheets

(56) References Cited

U.S. PATENT DOCUMENTS

| | | | | | |
|---|---|---|---|---|---|
| 426,087 | A | | 4/1890 | Wolkow | |
| 782,657 | A | | 2/1905 | Hubert | |
| 843,495 | A | | 2/1907 | Sander | |
| 968,199 | A | | 8/1910 | Schwartz | |
| 1,020,963 | A | | 3/1912 | Cake | |
| 1,073,226 | A | | 9/1913 | Freeman | |
| 1,176,482 | A | | 3/1916 | Orme | |
| 1,279,411 | A | | 9/1918 | Neuman | |
| 1,318,465 | A | * | 10/1919 | Seifarth | 66/4 |
| 1,318,604 | A | * | 10/1919 | Schneider | 66/4 |
| 1,366,212 | A | | 1/1921 | Pollard | |
| 1,375,119 | A | | 4/1921 | Stephen | |
| 1,405,744 | A | | 2/1922 | Sampliner | |
| 1,424,458 | A | | 8/1922 | Fleisher | |
| 1,500,383 | A | * | 7/1924 | Gourie | 66/4 |
| 1,599,040 | A | | 9/1926 | Clisby | |
| 1,647,060 | A | | 10/1927 | Speidel | |
| 1,694,849 | A | | 12/1928 | Fujii | |
| 1,705,860 | A | | 3/1929 | Hagihara | |
| 1,718,140 | A | | 6/1929 | Hagihara | |
| 1,776,561 | A | | 9/1930 | La Croix | |
| 1,994,659 | A | | 3/1935 | Mascarenhas | |
| 2,072,668 | A | | 3/1937 | Eltgroth | |
| 2,108,424 | A | | 2/1938 | Bakely | |
| 2,134,066 | A | | 10/1938 | Van Ness | |
| 2,186,692 | A | | 1/1940 | Boyer et al. | |
| 2,270,619 | A | | 1/1942 | Bowyer | |
| 2,274,572 | A | | 2/1942 | Yates | |
| 2,318,018 | A | * | 5/1943 | Semonsen | 66/4 |
| 2,360,416 | A | | 10/1944 | Gray | |
| 2,433,307 | A | | 12/1947 | Thomas | |
| 2,450,067 | A | | 9/1948 | Wolff | |
| 2,457,064 | A | * | 12/1948 | Parisl | 66/4 |
| 2,540,383 | A | | 2/1951 | Tillert et al. | |
| 2,545,409 | A | | 3/1951 | McCall | |
| 2,658,364 | A | * | 11/1953 | Carlson | 66/4 |
| 2,666,249 | A | | 1/1954 | Ruiz et al. | |
| 2,687,630 | A | * | 8/1954 | Carlson | 66/117 |
| 2,703,482 | A | | 3/1955 | Auran | |
| 2,707,052 | A | | 4/1955 | Brown | |
| 2,726,434 | A | | 12/1955 | Knoblock et al. | |
| 2,984,488 | A | | 5/1961 | Kirchner | |
| 3,054,214 | A | | 9/1962 | Smith et al. | |
| 3,069,739 | A | | 12/1962 | Jorgenson et al. | |
| 3,112,491 | A | | 12/1963 | Cleveland | |
| D204,442 | S | | 4/1966 | Brawley, Jr. | |
| 3,377,674 | A | | 4/1968 | Brassaw et al. | |
| 3,438,098 | A | | 4/1969 | Grabner | |
| 3,438,223 | A | | 4/1969 | Linstead | |
| 3,476,423 | A | | 11/1969 | Kentfield | |
| 3,476,426 | A | | 11/1969 | Lewin | |
| 3,572,679 | A | | 3/1971 | Strauff | |
| 3,636,987 | A | | 1/1972 | Forby | |
| 3,648,484 | A | * | 3/1972 | Gordon | 66/4 |
| 3,665,971 | A | | 5/1972 | Ileks | |
| 3,672,679 | A | | 6/1972 | Burns | |
| 3,678,709 | A | | 7/1972 | Nowicki et al. | |
| 3,688,357 | A | | 9/1972 | Nielsen et al. | |
| 3,693,976 | A | | 9/1972 | Flack | |
| 3,728,762 | A | | 4/1973 | Hogg | |
| 3,748,706 | A | | 7/1973 | Doyel | |
| 3,758,923 | A | | 9/1973 | Maude | |
| 3,800,372 | A | | 4/1974 | Daoust | |
| 3,805,345 | A | | 4/1974 | Antos | |
| 3,853,021 | A | | 12/1974 | Hayes | |
| 3,905,133 | A | | 9/1975 | Charman | |
| 4,018,543 | A | | 4/1977 | Carson et al. | |
| 4,023,245 | A | | 5/1977 | Zaltzman | |
| 4,032,179 | A | | 6/1977 | Goss | |
| 4,037,513 | A | | 7/1977 | Hobson | |
| 4,066,271 | A | | 1/1978 | Lohr | |
| D248,347 | S | | 7/1978 | McCollum | |
| 4,114,892 | A | | 9/1978 | Csoka | |
| 4,131,138 | A | | 12/1978 | Boisvert | |
| 4,179,129 | A | | 12/1979 | Loomis | |
| 4,248,063 | A | | 2/1981 | Wang | |
| 4,416,040 | A | * | 11/1983 | Towsley | 28/152 |
| 4,569,108 | A | | 2/1986 | Schwab | |
| 4,629,100 | A | | 12/1986 | Owens | |
| 4,667,965 | A | | 5/1987 | Helms, Jr. | |
| 4,680,021 | A | | 7/1987 | Maxim | |
| 4,729,229 | A | | 3/1988 | Whicker | |
| 4,844,473 | A | | 7/1989 | Landsberg | |
| D310,672 | S | | 9/1990 | Harvey et al. | |
| D330,668 | S | | 11/1992 | Nagamatsu | |
| 5,163,946 | A | | 11/1992 | Li | |
| 5,231,742 | A | | 8/1993 | Macbain | |
| 5,295,280 | A | | 3/1994 | Hudson et al. | |
| 5,328,374 | A | | 7/1994 | Stevens | |
| 5,331,725 | A | | 7/1994 | Chou | |
| 5,377,595 | A | | 1/1995 | Liu | |
| 5,426,788 | A | | 6/1995 | Meltzer | |
| 5,437,459 | A | | 8/1995 | Kirby | |
| 5,459,905 | A | | 10/1995 | Voyre | |
| 5,577,299 | A | | 11/1996 | Thompson et al. | |
| 5,639,090 | A | | 6/1997 | Stevens | |
| 5,687,775 | A | | 11/1997 | Thompson et al. | |
| D389,050 | S | | 1/1998 | Li | |
| 5,713,094 | A | | 2/1998 | Markey et al. | |
| 5,888,392 | A | | 3/1999 | Frizell | |
| 5,927,764 | A | | 7/1999 | Harriman | |
| D425,784 | S | | 5/2000 | Beugelsdyk et al. | |
| 6,065,968 | A | | 5/2000 | Corliss | |
| D426,425 | S | | 6/2000 | Hermanski | |
| 6,122,859 | A | | 9/2000 | Lazar | |
| 6,129,551 | A | | 10/2000 | Martin | |
| 6,131,778 | A | | 10/2000 | Etzion | |
| 6,146,144 | A | | 11/2000 | Fowler et al. | |
| 6,149,436 | A | | 11/2000 | Dunn | |
| 6,171,317 | B1 | | 1/2001 | Jackson et al. | |
| 6,213,918 | B1 | | 4/2001 | Rogers, Jr. | |
| 6,550,177 | B1 | | 4/2003 | Epple, Jr. | |
| D478,738 | S | | 8/2003 | Workman | |
| 6,880,364 | B1 | | 4/2005 | Vidolin et al. | |
| 6,923,026 | B1 | | 8/2005 | Clarke | |
| 7,040,120 | B2 | | 5/2006 | Hunter | |
| D552,463 | S | | 10/2007 | French et al. | |
| D570,923 | S | | 6/2008 | Vazquez Gastellu | |
| D578,383 | S | | 10/2008 | Adams | |
| 7,506,524 | B2 | | 3/2009 | Gustin | |
| D592,537 | S | | 5/2009 | Darnell | |
| 7,578,146 | B2 | | 8/2009 | Gustin | |
| 7,617,947 | B2 | | 11/2009 | Schafer | |
| D608,189 | S | | 1/2010 | Jackson et al. | |
| 7,909,609 | B2 | | 3/2011 | Molin | |
| 8,316,894 | B2 | | 11/2012 | Schaub | |
| 8,402,794 | B2 | * | 3/2013 | Sasur | 66/3 |
| 8,418,434 | B1 | | 4/2013 | Carruth et al. | |
| 8,485,565 | B2 | * | 7/2013 | Ng | 289/17 |
| D690,191 | S | | 9/2013 | Takakuwa et al. | |
| 8,622,441 | B1 | | 1/2014 | Ng | |
| 8,684,420 | B2 | | 4/2014 | Ng | |
| 2007/0114340 | A1 | | 5/2007 | Adams | |
| 2007/0199965 | A1 | | 8/2007 | Gouldson | |
| 2008/0156043 | A1 | * | 7/2008 | Gustin | 66/4 |
| 2008/0223083 | A1 | * | 9/2008 | Gustin | 66/1 A |
| 2009/0215013 | A1 | | 8/2009 | Molin | |
| 2010/0019495 | A1 | | 1/2010 | Oliveto | |
| 2011/0152946 | A1 | | 6/2011 | Frigg et al. | |
| 2011/0259465 | A1 | | 10/2011 | Schaub | |
| 2012/0047960 | A1 | * | 3/2012 | Sasur | 66/1 A |
| 2012/0112457 | A1 | * | 5/2012 | Ng | 289/1.5 |
| 2013/0020802 | A1 | * | 1/2013 | Ng | 289/1.5 |
| 2013/0300114 | A1 | * | 11/2013 | Ng | 289/1.5 |
| 2013/0307267 | A1 | | 11/2013 | Ng | |

OTHER PUBLICATIONS

International Search Report and Written Opinion for PCT Application No. PCT/US2011/041553 mailed on Feb. 23, 2012.

International Preliminary Report on Patentability for PCT Application No. PCT/US2011/041553 mailed May 16, 2013.

How to Make Rubber Band Bracelets Using Twistz Bandz—Instruction #1; http://www.youtube.com/watch?v=6nInnVEjrLU; Mar. 28, 2011.

(56) References Cited

OTHER PUBLICATIONS

Various rubber band crafts and bracelets using Rainbow Loom®; http://www.youtube.com/watch?v=oM6sOkZFz5o; Mar. 30, 2011.
How to make "Diamond" pattern rubber band bracelet using the Rainbow Loom® Kit; http://www.youtube.com/watch?v=dZa8dpZasKA; Jun. 8, 2011.
(Rainbow Loom®) Twistz Bandz product—with bloopers; http://www.youtube.com/watch?v=DbzS5u8ib_0; Jul. 6, 2011.
Defendants' Preliminary Non-Binding Invalidity Contentions, *Choon's Design LLC* v. *Zenacon, LLC et al.*, United States District Court for the Eastern District of Michigan, Case No. 2:13-cv-13568-PJD-RSW, Mar. 7, 2014.
Decision to Institute of Inter Partes Review of US Patent No. 8485565 dated May 20, 2014, Case IPR2014-00218, from the United States Patent and Trademark Office.
Petitioner's Request for Rehearing Under 37 CFR §42.71(d) filed on Jun. 3, 2014, Case IPR2014-00218, from the United States Patent and Trademark Office.
U.S. Appl. No. 13/938,717, filed Jul. 10, 2013, entitled "Brunnian Link Making Device and Kit".
U.S. Appl. No. 14/329,099, filed Jul. 11, 2014, entitled "Brunnian Link Making Device and Kit".
U.S. Appl. No. 14/331,456, filed Jul. 15, 2014, entitled "Hand Held Link Making Device and Kit".
U.S. Appl. No. 14/270,635, filed May 6, 2014, entitled "Device for Forming Brunnian Links".
Design U.S. Appl. No. 29/468,891, filed Oct. 24, 2013, entitled "Brunnian Link Forming Loom".
U.S. Appl. No. 14/226,096, filed Mar. 26, 2014, entitled "Monster Tail Loom for Forming Brunnian Links".
Design U.S. Appl. No. 29/468,549, filed Oct. 1, 2013, entitled "Brunnian Link Forming Loom".
Petition for Inter Partes Review of U.S. Patent No. 8,485,565 and Exhibits, filed in the United States Patent and Trademark Office.
Petition for Post-Grant Review of U.S. Patent No. 8,684,420 and Exhibits, filed in the United States Patent and Trademark Office on Aug. 5, 2014.
Petition for Inter Partes Review of U.S. Patent No. 8,485,565 and Exhibits, filed in the United States Patent and Trademark Office on Aug. 20, 2014.
How to make a fishtail rainbow loom bracelet; http://www.youtube.com/watch?v=ukv83Cvq3jk; Jul. 13, 2013.
European Search Report for EP Application No. 13840473.6 dated Jul. 3, 2014.
Takacas, Sarah (SarahLynnTea), How to Make Rubber Band Bracelets; Published Apr. 15, 2009 http://www.youtube.com/watch?v=e0k762PJ-D8.
Introduction video—Rainbow Loom (the next generation Twist Bandz kit), Published Sep. 24, 2012. http://www.youtube.com/watch?v=FUwf3CheGuw.
Lesson 21: "Sweet Heart" Rainbow Loom Bracelet by Choon; Published Jan. 21, 2013 http://www.youtube.com/watch?v=7I8MbYceEC0.
Rainbow Loom from Choon'Design, LLC; Published Jul. 24, 2013 http://www.youtube.com/watch?v=vhiVxnbE0CE/
How to make a rainbow loom starburst bracelet; Published Aug. 1, 2013 http://www.youtube.com/watch?v=RI7Akl5dJzo.
How To: Make the Rainbow Loom Single Band Bracelet; Published Aug. 12, 2013 http://www.youtube.com/watch?v=Wd3UdqPmKbA.

* cited by examiner

1) TEMPLATE

2) HOOK RB ON ONE END

2) LOOP RB OVER

4) HOOK RB BACK ON THE PIN

5) LOCK ONE END W/ C-CLIP

6) SLIDE THE HOOK THROUGH THE HOLLOW SLOT

BRUNNIAN LINK MAKING DEVICE AND KIT

REFERENCE TO RELATED APPLICATION

This application is a continuation in part of U.S. application Ser. No. 13/227,638 filed on Sep. 8, 2011, which claims priority to U.S. Provisional Application No. 61/410,399 filed on Nov. 5, 2010.

BACKGROUND

This disclosure generally relates to method and device for creating a linked item. More particularly, this disclosure relates to a method and device for creating a linked wearable item from elastic bands.

Kits that include materials for making a uniquely colored bracelet or necklace have always enjoyed some popularity. However such kits usually just include the raw materials such as different colored threads and beads and rely on the individual's skill and talent to construct a usable and desirable item. Accordingly there is a need and desire for a kit that provides not only the materials for creating a unique wearable item, but also that simplifies construction to make it easy for people of many skill and artistic levels to successfully create a desirable and durable wearable item.

SUMMARY

A Brunnian link is a link formed from a closed loop doubled over itself to capture another closed loop to form a chain. Elastic bands can be utilized to form such links in a desired manner. The example kit and device provides for creation of Brunnian link articles. Moreover, the example kit provides for the successful creation of unique wearable articles using Brunnian link assembly techniques.

The example kit includes a template for mounting an initial band and a hook utilized for attaching additional bands to the initial bands placed on the template. The template includes pins that hold the initial band in place while additional bands are linked onto each other. The kit further includes a clip utilized to attach ends once the desired length is formed.

These and other features disclosed herein can be best understood from the following specification and drawings, the following of which is a brief description.

DETAILED DESCRIPTION

Figure 1:
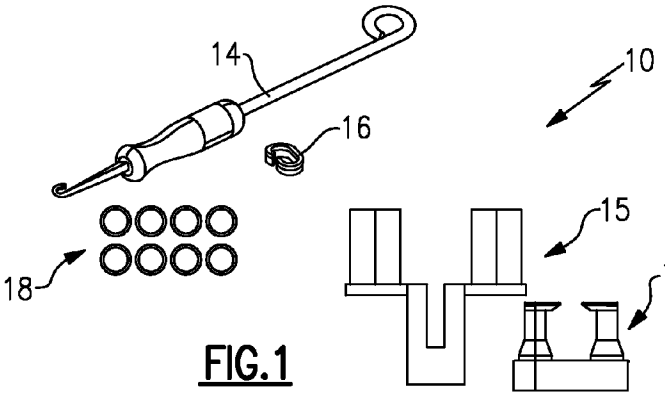
FIG. 1 perspective view of an example kit for creating a Brunnian link article.
Figure 2:
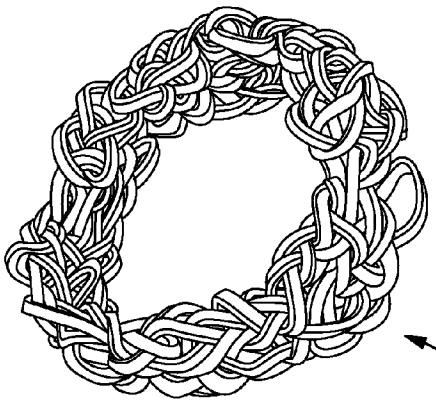
FIG. 2 is schematic view of Brunnian link articles.

Referring to FIGS. 1 and 2, an example kit is indicated at 10 for creating Brunnian link items such as bracelets, necklaces and other wearable or decorative article as generally indicated at 26 in FIG. 2. The example kit 10 includes one of a template 12 (FIG. 4-6), or 15 (FIGS. 10-12), a clip 16 and a hook 14. The example kit 10 also includes a number of elastic members 18 that are used with the kit 10 to form Brunnian links for the resulting wearable article 26. The elastic members 18 are consumed as articles 26 are fabricated, and are replaced and replenished with additional elastic members. Moreover, the example elastic members 18 are of a size corresponding with the example template 12. Further, although a single clip 16 is illustrated, the example kit 10 will include many clips 16 to provide for the fabrication of many articles 26.

Figure 3:
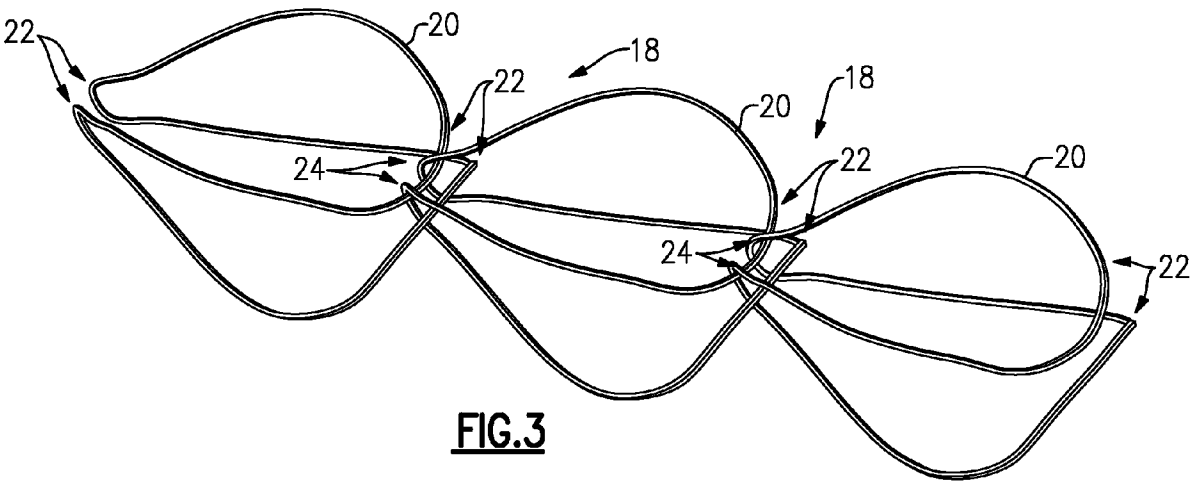
FIG. 3 is a schematic view of a series of Brunnian links.

Referring to FIG. 3, a Brunnian link 20 is formed from a continuous looped structure without forming an actual knot. Several links 20 are formed in a chain to form a circular structure. Ends 22 of each elastic member 18 are secured and a durable wearable article 26 is created. In this example three links 20 forming a single chain. Each link 20 is formed by capturing the ends 22 of one loop structure with a mid portion 24 of another loop structure in series. Each link 20 depends on the previous and subsequent links 20 to maintain the desired shape and integrity. Removing one link 20 results in all of the links becoming loose from each other.

Figure 6:
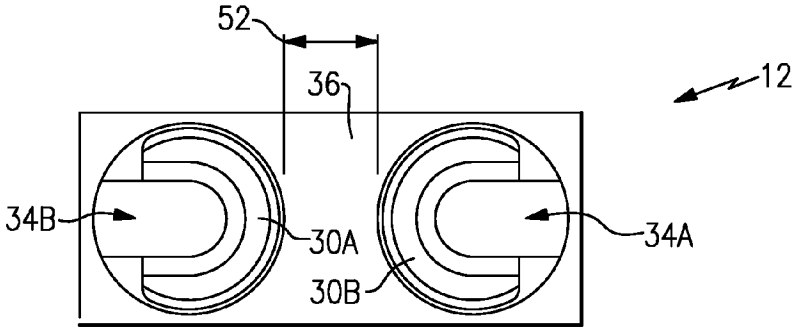
FIG. 6 is a top view of the example template.
Figure 4:
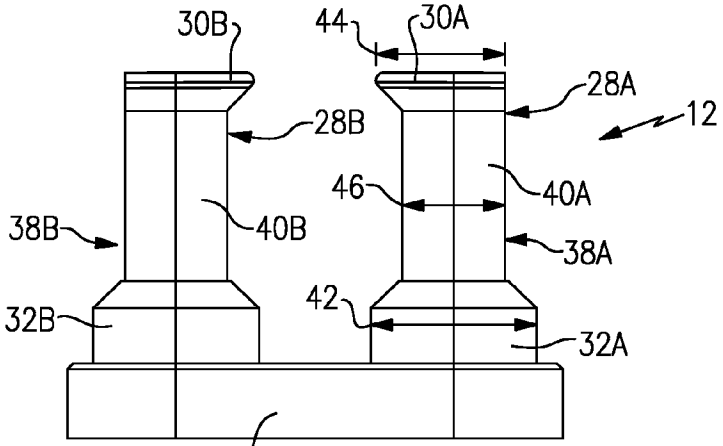
FIG. 4 is a side view of an example template.
Figure 5:
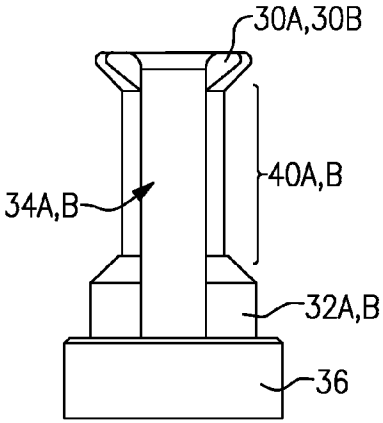
FIG. 5 is an end view of the example template.

Referring to FIGS. 4, 5 and 6, the example template 12 includes two pins 28A, 28B spaced a distance 52 apart from each other. Each of the pins 28A, 28B includes a flange 30A, 30B , a base 32A, 32B, and an access groove 34A,34B. The pins 28A, 28B are connected at the base 32A, 32B by a bridge 36. The bridge 36 defines the distance 52 between the pins 28A, 28B.

The access grooves 34A, 34B are disposed on outward facing sides 38A, 38B of the template 12. Each of the access grooves 34A, 34B extend entirely through the pins 28A, 28B including through the flanges 30A, 30B and the bases 32A, 32B and the bridge 36.

The pins 28A, 28B include a barrel portion 40A, 40B between the corresponding flanges 30A, 30B. The barrel portion 40A, 40B is formed of a diameter 46 that is less than a diameter 44 of the flanges 30A, 30B and a diameter 42 of the base 32A, 32B. The barrel portion 40A, 40B support the elastic band 18, while the flanges 30A, 30B and the base 32A, 32B prevent the elastic bands 18 from sliding off.

Each of the flanges 30A, 30B is interrupted by the corresponding access grooves 34A, 34B. The access grooves 34A, 34B are sized to receive an end of the hook tool 14.

Figure 8:
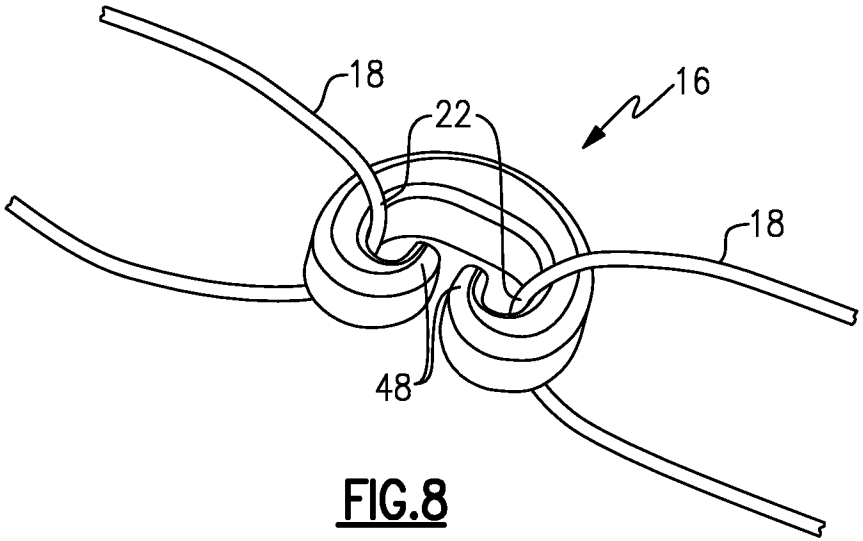
FIG. 8 is perspective view illustrating elastic bands secured with the example clip.
Figure 7:
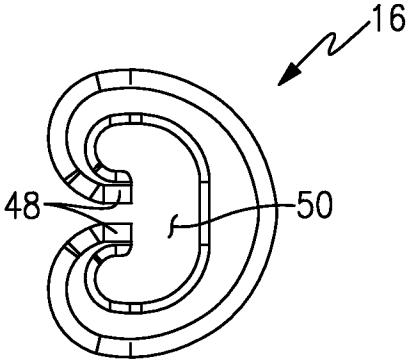
FIG. 7 is a plan view of an example clip for securing loose ends of a Brunnian linked article.

Referring to FIGS. 7 and 8, the example clip 16 is generally C-shaped with inwardly facing ends 48. The inwardly facing ends 48 point inwardly to an open space 50 where parts of the elastic members are kept 18. The inwardly facing ends 48 prevent ends 22 from sliding out from the inner area 50 off of the clip 16.

Referring to FIGS. 9A-K, the example template 12 is utilized for the formation of a series of Brunnian links 20 as illustrated in FIG. 3. As appreciated, elastic bands 18 can be difficult to manipulate and hold during the construction of a desired article. The example template 12 provides for holding of an initial number of links 20 to facilitate the initial few links of a desired linked article. The template 12 includes the first and second pins 28A, 28B along with the full height groove 34.

Figure 9A:
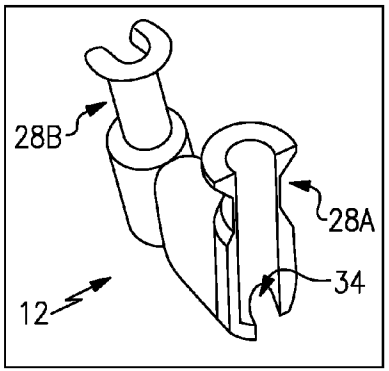
FIGS. 9A-9K are views of an example method of creating a Brunnian link article using the example template and kit.
Figure 9B:
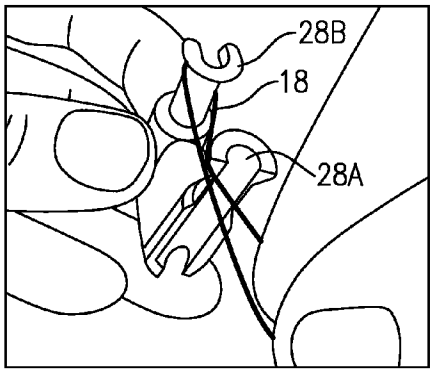
Figure 9C:
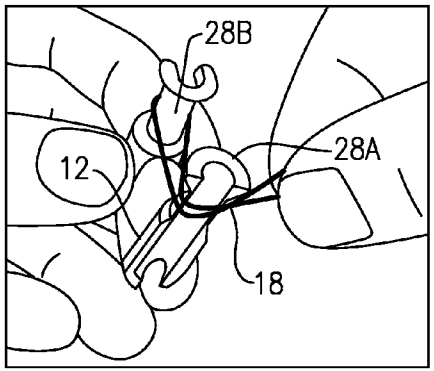
Figure 9D:
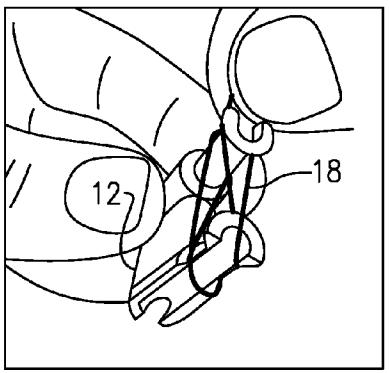
Figure 9E:
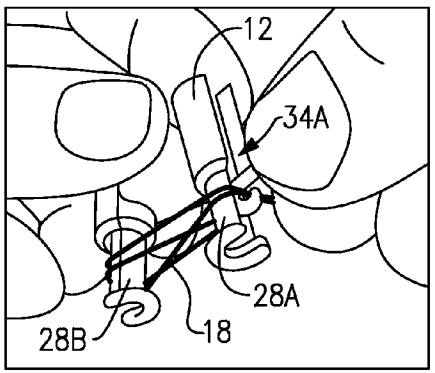

The initial step illustrated in FIG. 9B includes assembling a first end of an elastic band 18 on to the second pin 28B. The first elastic band 18 is then pulled and looped around the first pin 28A as shown in FIG. 9C. Once looped around the first pin 28A, the second end 18 is hooked back onto the second pin 28B as shown in FIG. 9D. With the first elastic band 18 assembled to the template 12 a clip 16 as is shown in FIG. 9E is attached to the band 18. The clip 12 is inserted into the groove 34A of the first pion 28A and under the ends of the elastic band 18 such that the band 18 is received within the open area 50.

Figure 9F:
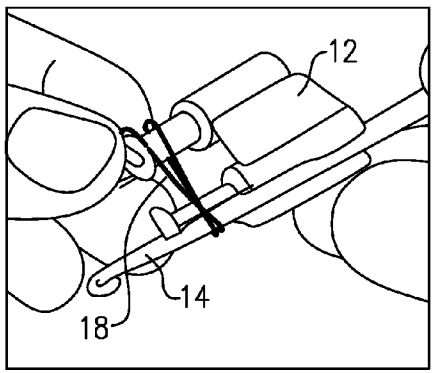
Figure 9I:
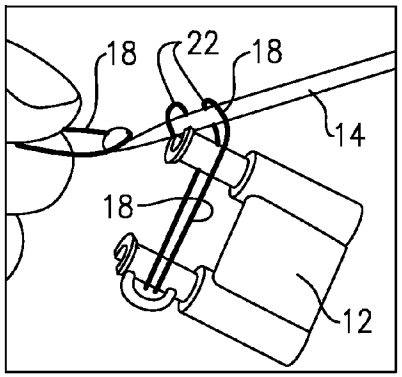

Once the clip 16 is hooked to the ends 22 of the elastic band 18, the hook tool 14 is inserted through the access groove 34 as shown in FIG. 9F. A second elastic band 18 is then hooked by the hook 14 as shown in FIG. 9G. The end of the hook 14 is shown extending through the access groove 34A such that it extends outward from the flange 30A to provide for hooking of the second band 18.

Figure 9H:
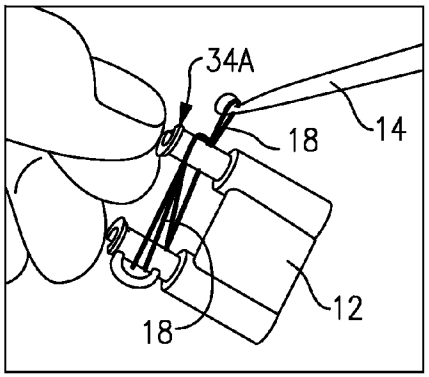
Figure 9G:
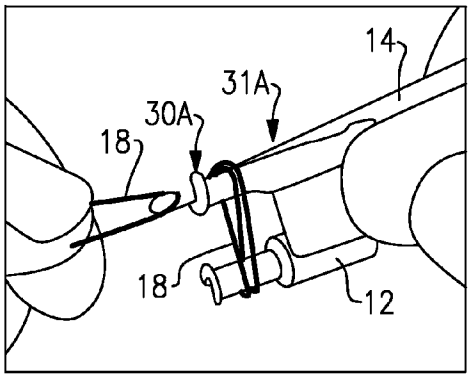
Figure 9K:
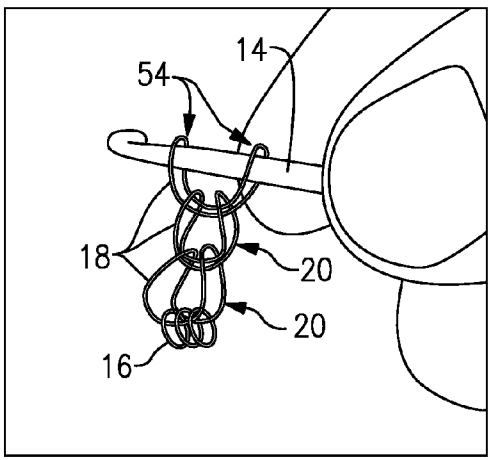

One end of the second band 18 is then pulled through the groove 34A while holding the other end as shown in FIG. 9H. The hook 14 is then put through the ends 22 of the second band 18 to hold them in an orientation where the midsection 24 is wrapped about the first band 18 that is secured to the template 12 as shown in FIG. 9I. A third band 18 is then hooked utilizing the hook 14 and pulled through the second band 18.

Figure 9J:
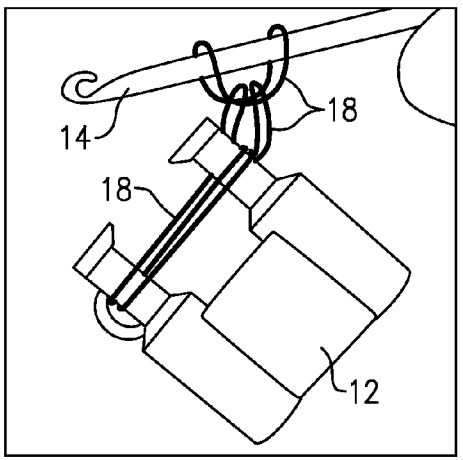

The third band 18 is looped over the hook 14 to hold the third band 18 in the orientation illustrated in FIG. 9J. The hook 14 is utilized to hold one band 18 onto the subsequent band 18 and prepare for the threading of subsequent band 18 through the previous band 18. The process is repeated until a desired number of bands 18 are linked together to form a chain as illustrated FIG. 9K. Once the desired length and number of links 20 are formed, the first band 18 including the clip 16 can be removed from the template 12. The clip 16 is then circled around and clipped onto the loose ends indicated at 54 to complete the article.

Figure 10:
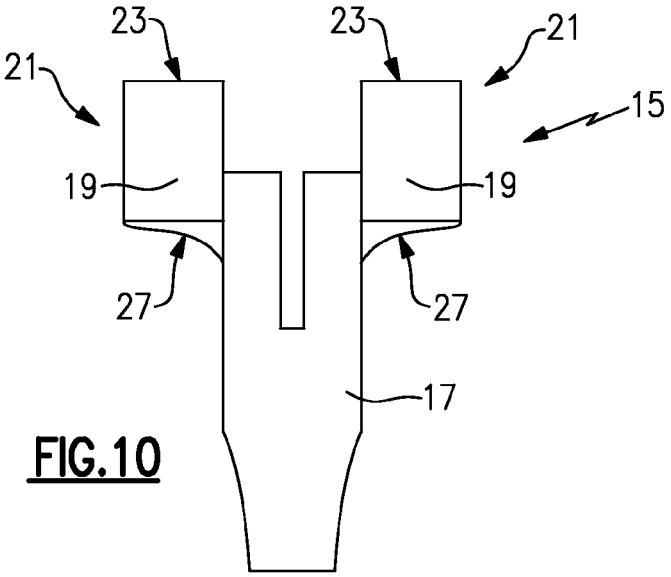
FIG. 10 is a side view of another example template.
Figure 11:
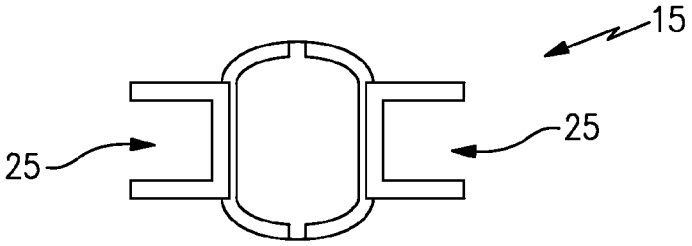
FIG. 11 is a top view of the example template shown in FIG. 10.
Figure 12:
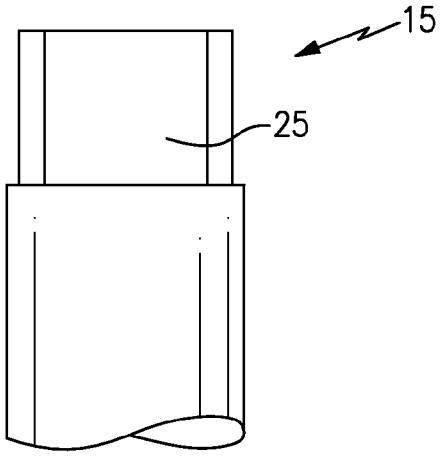
FIG. 12 is a side view of the example template shown in FIGS. 10 and 11.

Referring to FIGS. 10, 11 and 12, another template 15 includes a holder 17 that supports pins 21. Each of the pins 21 includes a first or top end 23 and a base end 27. The pins 21 each include arms 19 disposed on either side of an access groove 25. The entire template 15 is a single part that is held during creation of the article. The pins 21 provide support for the elastic member 18 during fabrication of a linked article similar to that indicated at 26 in FIG. 2. The example template 15 is utilized according to the same assembly procedure set out in FIGS. 9*a-k*.

Accordingly, the example kit and method provide for the creation of many different combinations and configurations of Brunnian links for the creation of bracelets, necklaces, and other wearable items. Moreover, the example kit is expandable to further create and expand the capabilities of potential Brunnian link creations. Further, the example kit provides for the creation of such links and items in an easy manner allowing persons of varying skill levels to be successful in creating unique wearable items.

Although an example embodiment has been disclosed, a worker of ordinary skill in this art would recognize that certain modifications would come within the scope of this disclosure. For that reason, the following claims should be studied to determine the scope and content of this invention.

What is claimed is:

1. A device for creating an item consisting of a series of links, the device comprising:

a template including at least two pins spaced apart from each other, each of the pins including a first end, a base end, and an access groove, wherein the first end includes an outwardly extending flange and is interrupted by the access groove.

2. The device as recited in claim 1, including a bridge portion extending between the base end of each of the pins.

3. The device as recited in claim 1, wherein the access groove is disposed on outward facing sides of the template.

4. The device for creating an item consisting of a series of links, the device comprising:

a template including at least two pins spaced part from each other, each of the pins including a first end, a base end, and an access groove; and a bridge portion extending between the base end of each of the pins, wherein the first end includes an outwardly extending flange and each of the access grooves extend entirely through each of the pins including the first end and the base end.

5. The device as recited in claim 1, wherein each of the pins include a barrel portion between the first end and the base end.

6. The device as recited in claim 5, wherein the base end includes a diameter greater than a diameter of the barrel portion.

7. A method of creating a linked item comprising the steps of:

assembling a first end of an elastic band on to a first pin of a template, where the template includes at least two pins spaced apart from each other, each of the pins including a first end, a base end, and an access groove;

looping a second end of the elastic band around a second pin of the template;

assembling the second end of the elastic band onto the first pin;

pulling a second elastic band through the access groove and making a loop with the first and second ends of the second elastic band; and capturing and pulling subsequent ends through the looped ends of the previous elastic band until a desired link length and configuration is obtained.

8. The method as recited in claim 7, wherein capturing one end of the elastic band includes using a hook tool reaching into the access groove of the pin to extend below the top most elastic band and grasp a bottom elastic band with the hook tool.

9. The method as recited in claim 8, including the step of inserting ends of the elastic bands into a clip to form the linked item.

10. A kit for creating an item consisting of a series of links, the kit comprising:

a template including at least two pins spaced apart from each other, each of the pins including a first end, a base end, and an access groove; and at least one clip including inward facing ends for securing ends of the series of links together.

11. The kit as recited in claim 10, wherein the clip comprises a C-shape and the inward facing ends extend in a direction perpendicular to an opening.

12. The kit as recited in claim 11, wherein the clip defines an interior space for receiving portions of elastic members and the inward facing ends extend into the interior space for preventing elastic members from moving through the opening.

13. The kit as recited in claim 10, including a hook for manipulating elastic members relative to each other.

14. The kit as recited in claim 13, including a plurality of elastic members for forming the series of links.

15. The kit as recited in claim 14, wherein the series of links comprise a series of Brunnian links.

16. The kit as recited in claim 10, wherein the first end is interrupted by the access groove.

17. The kit as recited in claim 16, wherein the base end is interrupted by the access groove.

18. The kit as recited in claim 10, including a bridge portion extending between the base end of each of the pins.

19. The kit as recited in claim 18, wherein the access groove is disposed on outward facing sides of the template.

20. The kit as recited in claim 10, wherein the first end includes an outwardly extending flange.

21. The device as recited in claim 4, wherein the access groove is disposed on outward facing sides of the template.

22. The device as recited in claim 4, wherein each of the pins include a barrel portion between the first end and the base end.

23. The device as recited in claim 4, including a clip that defines an interior space for receiving portions of elastic members.

24. The device as recited in claim 4, including a hook for manipulating elastic links supported on the template during assembly of an item consisting of a series of links.

* * * * *